United States Patent [19]

Wosika

[11] 4,435,121

[45] Mar. 6, 1984

[54] TURBINES

[75] Inventor: Leon R. Wosika, El Paso, Tex.

[73] Assignee: Solar Turbines Incorporated, San Diego, Calif.

[21] Appl. No.: 277,394

[22] Filed: Jun. 25, 1981

Related U.S. Application Data

[63] Continuation of Ser. No. 79,584, Sep. 27, 1979, abandoned.

[51] Int. Cl.[3] ..... F01D 1/16

[52] U.S. Cl. ..... 415/56; 415/59; 415/202

[58] Field of Search ..... 415/52, 56, 59, 92, 415/202

[56] References Cited

U.S. PATENT DOCUMENTS

| | | | |
|---|---|---|---|
| 811,805 | 2/1906 | Stumpf | 415/202 |
| 858,500 | 7/1907 | Dake | 415/52 |
| 911,492 | 2/1909 | Goldsborough | 415/202 |
| 911,577 | 2/1909 | Dake | 415/56 |
| 992,433 | 5/1911 | London | 415/56 |
| 1,047,918 | 12/1912 | Collier | 415/56 |
| 1,676,806 | 7/1928 | Smalley | 415/92 |
| 1,722,721 | 7/1929 | Wait | 415/59 |
| 4,150,918 | 4/1979 | Theis, Jr. | 415/202 |

*Primary Examiner*—Stephen Marcus
*Assistant Examiner*—Joseph M. Pitko
*Attorney, Agent, or Firm*—LeBlanc, Nolan, Shur & Nies

[57] ABSTRACT

A full admission radial impulse turbine and turbines with full admission radial impulse stages.

7 Claims, 11 Drawing Figures

Fig.3
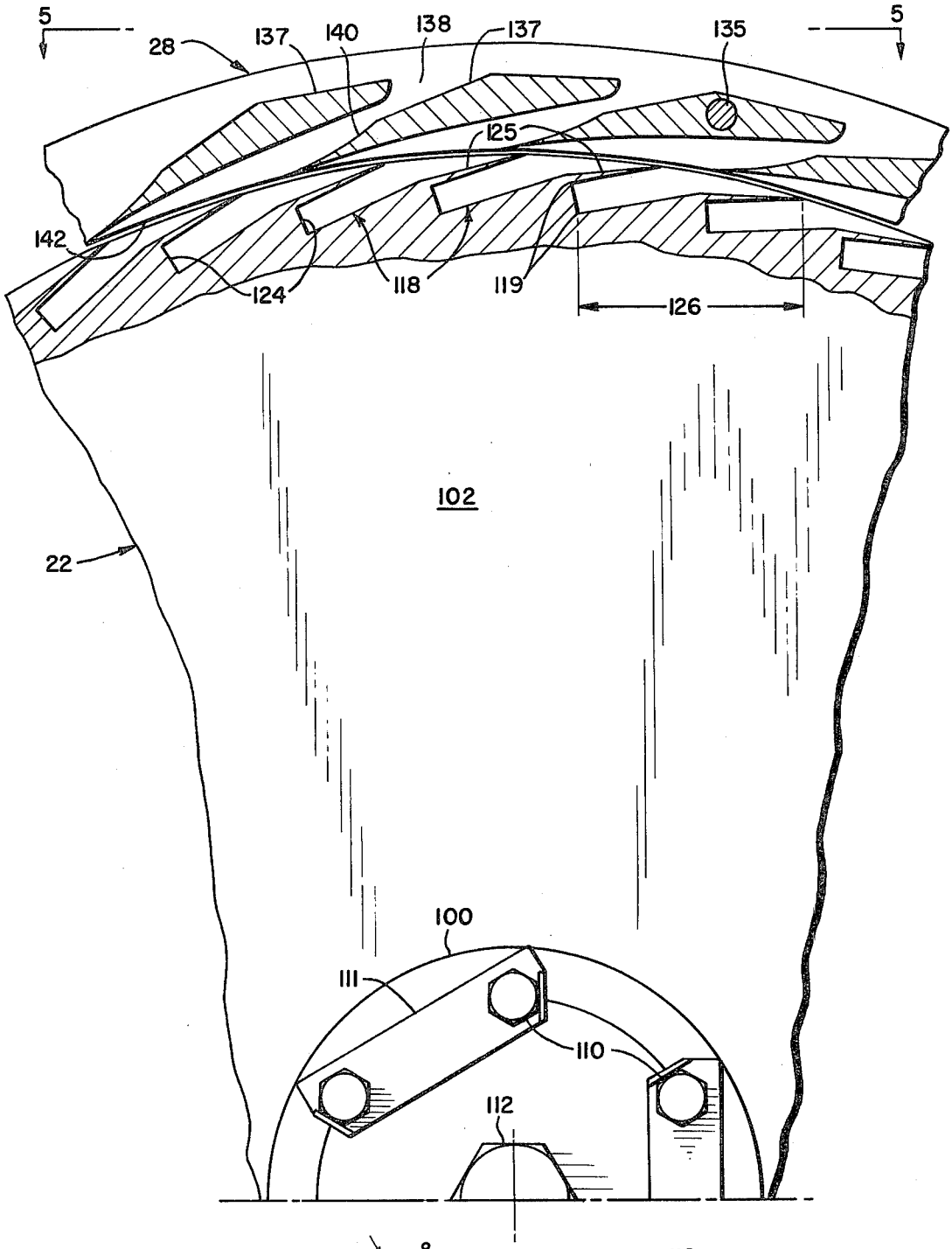
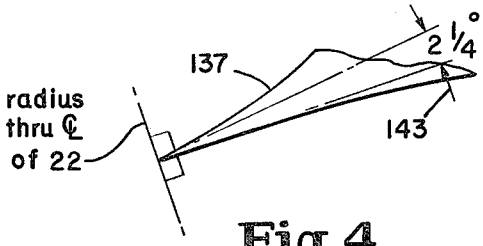
Fig.4
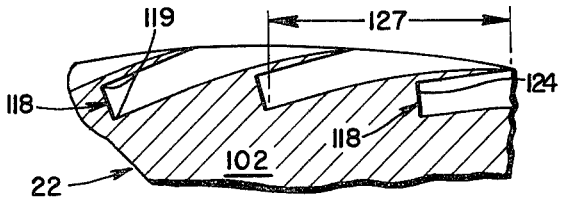
Fig.6

TURBINES

This is a continuation, of application Ser. No. 79,584, filed Sept. 27, 1979, now abandoned.

The present invention relates in one aspect to novel, improved turbines of the radial impulse type.

In another aspect, the present invention relates to novel turbines which include one or more radial impulse stages of an improved type and which may, moreover, employ radial impulse stages in combination with axial flow stages. Turbines of the latter class may be of the once-through type. Or they may be of the dual pressure type in which high and low pressure sections are supplied with an elastic working fluid at different pressures.

Radial impulse turbines, typically hydraulic, have been well-developed since before the turn of the century. Probably the best known of these is the Pelton Wheel.

In their most recent reincarnations, turbines of the type in question include a rotor or wheel with buckets or pockets oriented transversely to the direction of wheel rotation and opening onto the periphery of the wheel. An elastic working fluid such as air, steam, or natural gas is supplied to the buckets via nozzles formed in, or supported from, a nozzle ring surrounding the turbine wheel and aligned with the entrance ends of the buckets.

The novel radial impulse turbines disclosed herein are of the character just described but differ from those previously proposed in several important respects.

One is the high velocity at which the working fluid is introduced into the buckets of the turbine wheel. Typically, this will be on the order of Mach 2.3, giving turbines in accord with the present invention an efficiency of ca. 73 percent. Conventional radial impulse turbines, in contrast, have efficiencies near 50 percent.

A second important feature of the present invention is that the buckets in the turbine wheel are circular and, furthermore, are so oriented and related that the flow vectors of the working fluid entering and exiting from the buckets are parallel to each other and to the direction of wheel rotation. This novel bucket design is significantly more efficient than conventional flow designs.

Efficiency is also promoted by shrouding those portions of the pockets between their entrances and exits with a shroud which extends completely around the circumference of the rotor. There is a circulation of unspecified character in those regions. The shrouding keeps the character of that flow constant, eliminating the windage loss that occurs in conventional, unshrouded or partially shrouded radial impulse turbines.

Yet another unique, and important, attribute of the novel radial impulse turbines disclosed herein is that there is essentially full admission of the working fluid from a locus which encircles the wheel and is essentially uninterrupted.

This novel arrangement is materially superior to the conventional, partial admission arrangement shown in U.S. Pat. No. 3,976,389 issued Aug. 24, 1976, to Theis, for example. In the conventional partial admission design, the turbine wheel coasts as it rotates between the working fluid supply nozzles; and this is inefficient as it causes wakes and other disturbances in the working fluid as it flows to the turbine wheel buckets.

Efficiency of the novel turbines disclosed herein is also promoted by the particular improved nozzle designs employed in them. One feature which has been found to contribute significantly to increased efficiency is the use of rectangular nozzles (preferably with square outlets) in combination with buckets of like configuration. This arrangement effectively reduces unwanted, power wasting shock and turbulence.

The novel turbines disclosed herein also feature, for certain applications, a convergent-divergent nozzle design which has a curved inner wall. This novel design can be employed to best advantage when the working fluid is air or other non-condensible gas.

Turbines employing steam and comparable elastic fluids as the working fluid will typically be equipped with convergent nozzles rather than the novel convergent-divergent design just discussed. This gives such turbines a wider operating range.

Another important feature of the novel nozzles employed in the present invention is a drastically reduced wedge angle at the trailing edges of the nozzle ring vanes by which the nozzles are bounded and separated. An eleven degree or greater wedge angle is typical in prior art designs. I have found, however, that markedly increased efficiency can be obtained by decreasing this angle to a maximum of three degrees. This also reduces wakes and comparable flow disturbances. The decrease in wedge angle, in addition, reduces stresses imposed on the rotor by working fluid distributed to it from the turbine nozzles.

The principles of the present invention can be employed to advantage in the design of gas turbines; i.e., turbines designed to be operated by air, natural gas and other working fluids of comparable character.

Such turbines may have a single or multiple stages; and the wheel, or wheels, are preferably overhung for designs employing up to two stages. In typical applications this mounting arrangement promotes ease in assembly and servicing; it also minimizes friction losses and reduces bearing wear.

Multiple stage turbines also feature a novel arrangement for transferring the working fluid between stages that is characterized both by its effectiveness and simplicity.

Features as just described can also be incorporated in steam turbines designed in accord with the principles of the present invention.

One novel turbine of this type, employing steam as the working fluid, has a high pressure section including radial impulse stages of the character described above and a low pressure section equipped with conventional axial flow stages. This novel combination of radial impulse and axial flow staging is significantly more efficient than conventional steam turbine designs but, nevertheless, cost competitive with the latter.

The novel dual pressure turbines described herein also feature a single shaft for the high and low pressure sections, a design made possible by the combination of radial impulse and axial turbine staging discussed above. This eliminates the need for gearing between the high and low pressure sections along with the associated expense, power loss, etc.

The novel dual pressure turbines disclosed herein also feature a novel arrangement for combining steam discharged from the high pressure section with steam supplied to the turbine at a second low pressure and delivering the mixture to the low pressure turbine section.

Maximum utilization of available energy is promoted by this feature in typical applications of the invention.

A second novel turbine disclosed herein and employing both radial impulse and axial flow staging in accord with the principles of the present invention is of the once-through type. In it all of the working fluid is supplied to the turbine at one pressure, and the working fluid is discharged directly from the radial impulse staging into the first of the axial flow stages. At some sacrifice in efficiency, this novel design reduces complexity, lowers maintenance costs, and increases reliablity; and it has a faster response time. Consequently, my once-through turbines of the radial impulse-axial flow type may prove superior to those of the dual pressure type in applications such as naval shipboard use where the advantages just identified take precedence over efficiency.

From the foregoing, it will be apparent to the reader that one important and primary object of the present invention resides in the provision of novel, improved radial impulse turbines.

Related and also important, but more specific, objects of the invention reside in the provision of radial impulse turbines in which efficiency is promoted by one or more of the following features: wheels with buckets so configured that the flow vectors of the working fluid entering and exiting from the buckets are parallel to each other and to the path of rotation of the turbine wheel; complete shrouding of the buckets; full admission of the working fluid to the buckets; improved nozzle design; and efficient mounting of the turbine wheel or wheels.

Another important, primary object of the present invention resides in the provision of turbines having one or more radial impulse stages of the character and having the appurtenant advantages provided by those features identified in the preceding objects.

A related and important but more specific object of the invention is the provision of multiple stage turbines having radial impulse stages as aforesaid and a novel, improved arrangement for transferring the working fluid between stages.

Yet another important, primary object of the present invention is the provision of multiple stage turbines which employ a combination of radial impulse and axial flow stages and which are designed to maximize operating efficiency.

A related important, primary object of the invention is the provision of novel, improved, dual pressure turbines capable of achieving the goal identified in the preceding paragraph.

Another related, also important, object of the invention resides in the provision of dual pressure turbines which can be employed to particular advantage in combined cycle systems and in comparable applications.

Other related and important, but more specific, objects of the invention reside in the provision of dual pressure turbines:

which have one or more radial impulse stages as aforesaid;

in which, in conjunction with the preceding object, the radial impulse stage or stages are incorporated into a high pressure section and the turbine has a low pressure section with multiple axial flow stages;

which are of single shaft design; and/or which have a novel arrangement for mixing lower pressure working fluid supplied thereto with steam exhausted from a high pressure section and distributing the mixture to a low pressure section.

A still further primary and important object of my invention is the provision of turbines which employ a combination of radial impulse and axial flow stages and which are characterized by relatively low weight, complexity, and maintenance requirements; a high degree of reliability; and a fast response time.

A related, important, and primary object of the invention is the provision of novel, improved, once-through turbines with the attributes identified in the preceding paragraph.

Other important objects and features and additional advantages of the present invention will become apparent from the appended claims and as the ensuing detailed description and discussion proceeds in conjunction with the accompanying drawing, in which:

FIG. 3 is a fragmentary view of the impulse stage looking in the direction indicated by arrows 3—3 of FIG. 2;

FIG. 4 is a fragment of FIG. 3 drawn to an enlarged scale and included to show the wedge at the trailing edges of certain vanes which determine the configuration of the nozzles in the nozzle ring of the radial impulse stage;

FIG. 6 is a fragment of a view like FIG. 3 showing an alternate form of impulse wheel pocket configuration;

Figure 1:
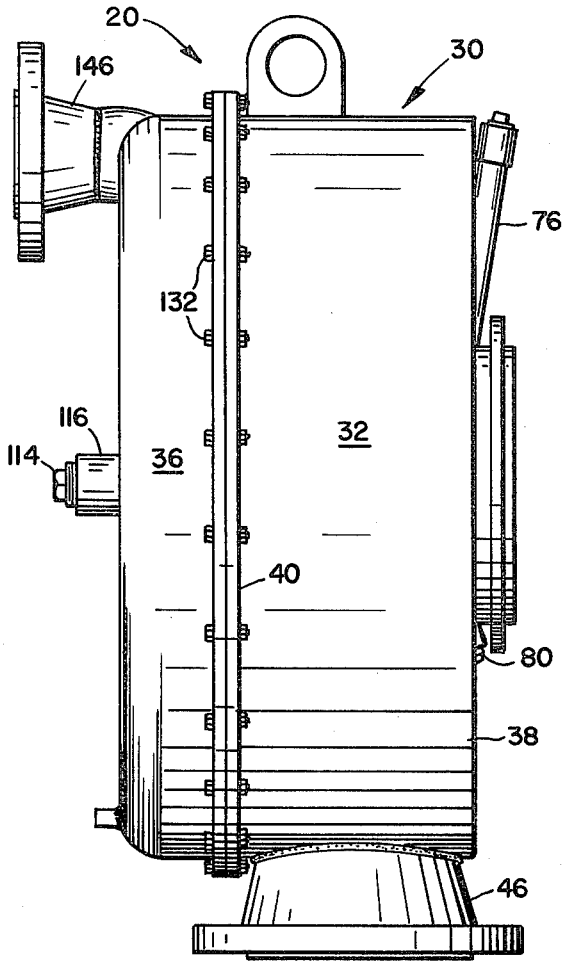
FIG. 1 is a side view of a turbine constructed in accord with the principles of the present invention; the turbine has a single radial impulse stage also embodying and constructed in accord with the principles of the present invention.
Figure 2:
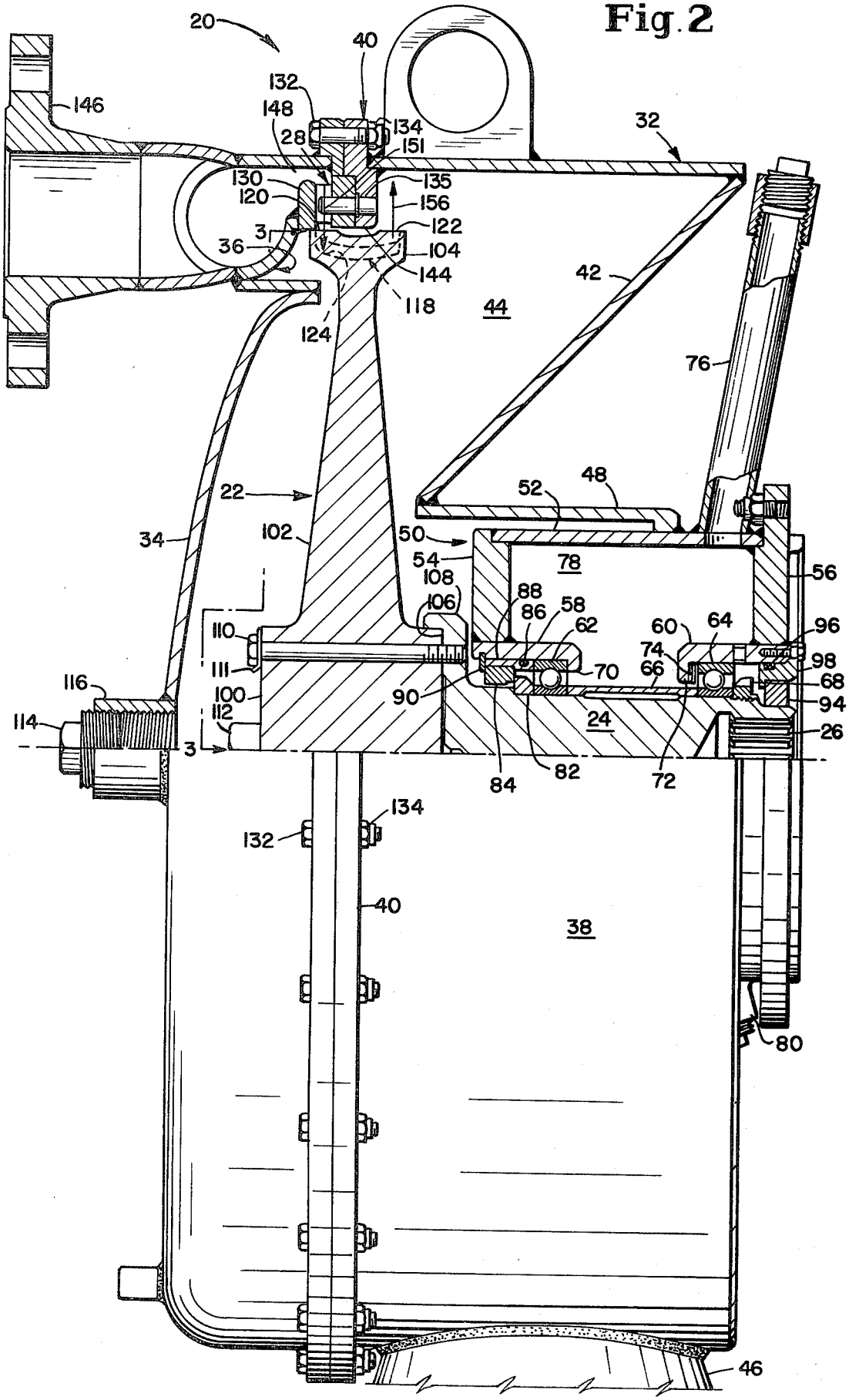
FIG. 2 is a partial section through the turbine of FIG. 1 showing the components of the impulse stage.

Referring now to the drawing, FIGS. 1 and 2 depict a single stage, single pass, radial impulse turbine 20 constructed in accord with, and embodying, the principles of the present invention.

Turbine 20 includes a rotor or wheel 22. The wheel is bolted to the front or upstream end of a shaft 24 having an externally accessible, splined power take-off 26 in its downstream end; and the wheel is surrounded by a nozzle ring 28.

Those components just identified are housed in a casing 30 composed of a discharge housing 32, a dish-shaped head 34 at the upstream end of housing 32, and an annular inlet manifold 36 surrounding and welded to head 34.

Discharge housing 32 includes a cylindrical housing member 38 and an annular flange 40 at the upstream end of member 38(head 34 is bolted to flange 40). The housing also includes a forwardly extending, frustoconial member 42 which is welded, at its outer, downstream end, to cylinder 38.

This member cooperates with cylindrical member 38 to form an annular discharge plenum 44. The latter discharges working fluid exhausted from wheel 22 into an outlet 46 which is welded to turbine casing member 38.

A final component of discharge housing 32 is a tubular bracket 48, welded, at its upstream end, to the inner, upstream end of frustoconical housing member 42. Fixed concentrically in bracket 48 is a shaft support assembly 60 which includes a longitudinally extending tubular support 52, annular flanges 54 and 56 fixed to the upstream and downstream ends of the support; and flanged bearing supports 58 and 60 which are fixed to upstream and downstream flanges 54 and 56, respectively.

Surrounding shaft 24 and rotatably supporting it in casing 30 are conventional ball bearings 62 and 64 housed in bearing supports 58 and 60.

The bearings are maintained in longitudinally spaced relationship relative to the shaft by a sleeve 66 extending between the inner races of the bearings and a nut 68 threaded on the rear end of the shaft. The shaft/bearing assembly thus formed is longitudinally fixed relative to the shaft support assembly and the other components of turbine 20 by inwardly extending radial flanges 70 and 72 on bearing supports 58 and 60.

A bearing spring 74 is interposed between flange 72 and the outer race of downstream bearing 64 to compensate for manufacturing tolerances and to absorb axial stresses on the shaft.

Lubricant is supplied to the bearings through a filler 76 which communicates with a chamber 78 in shaft support assembly 50. Lubricant is removed from that chamber through a drain 80.

Leakage of the lubricant into the working fluid discharge plenum 44 is prevented by runner 82, seal 84, and O-ring 86.

Runner 82 is clamped between the inner face of upstream bearing 62 and a shoulder on shaft 24.

Seal 84, which has sliding engagement with the upstream face of runner 82 and keeps lubricant from leaking past the runner, is mounted in a seal adapter 88 located at the forward end of upstream bearing support 58. The adapter is retained in place by a snap ring 90 fitted in the front end of the support.

O-ring 86 keeps the lubricant from leaking between the seal adapter and bearing support 58.

Leakage through the annular flange 56 at the downstream or rear end of turbine 20 is prevented by an annular seal 94 and an O-ring 96. Both are supported from a seal adapter 98 bolted to downstream bearing support 60 with seal 94 extending between the adapter and shaft 24 and the O-ring 96 between the seal adapter and the bearing support.

In gas turbine applications the wheel 22 housed in casing 30 will typically be fabricated of a material which does not become brittle at low temperatures, such as an aluminum alloy, as the working fluid may be discharged from wheel 22 at a temperature of −90° F. or lower.

Wheel 22 has a hub 100 surrounded by a tapered disc 102 which merges into an axially extending, circular flange 104 around its outer periphery.

Hub 100 is seated against a flat 106 at the upstream end of shaft 24 and is surrounded by a circular positioning flange 108. Bolts 110 through hub 100 at equiangularly spaced intervals around its periphery and threaded into shaft 24 secure wheel 22 to the shaft. Lock plates 111 keep bolts 110 from being loosened by vibration.

A hexagonal lub 112 on the front of rotor 22 can be reached by unscrewing a plug 114 from a hollow coupling 116 fixed to casing head 34. By attaching a wrench to the lug the rotor can be hand torqued to insure that it is free.

Figure 5:
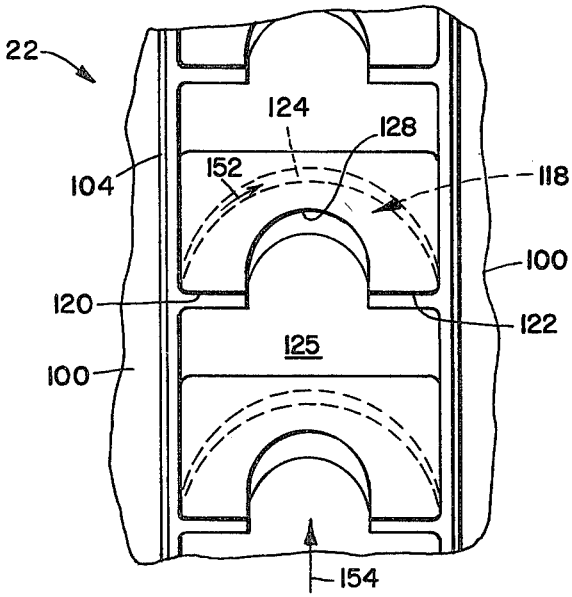
FIG. 5 is a fragmentary view of the impulse stage wheel looking in the direction indicated by arrows 5—5 of FIG. 3.

Referring now to FIGS. 2, 3, and 5, there are equiangularly spaced buckets 118 in flange 104; and they open onto the periphery of rotor 22. These buckets, typically formed by milling with the cutter inclined at an angle of 18° to the radial, have an entrance 120 adjacent the upstream side of the wheel, an exit 122 adjacent the downstream side of the wheel, and a circular impulse surface 124 between the entrance and the exit.

Maximum efficiency can be obtained by so milling the buckets as to produce transition curves on their entrance and exit sides. This minimizes losses attributable to the working fluid impinging on the rotor as it changes direction in flowing through the buckets.

Buckets 118 have a rectangular cross section with nearly square corners 119 (see FIG. 3).

Flats 125 are milled in rotor 22 on the trailing edge sides of buckets 118, typically at an angle of about 3° to the adjacent surface of the next approaching bucket. This removes excess metal from the rotor and, also, produces a goodmatch to the relative spouting velocity of the working fluid discharged from the nozzle ring. That, together with the sharp leading edges produced by milling flats 125, minimizes flow irregularities and contributes to efficiency.

A further increase in efficiency can be obtained by making the profile of the surface identified by reference character 126 in FIG. 3 a smooth curve as shown in FIG. 6 wherein the curved surface is identified by reference character 127. Appropriate curves can be readily generated by casting.

A groove is milled in rotor 22 before buckets 118 are milled. This groove, which extends continuously around the periphery of the wheel and opens onto its outer periphery, generates slots or grooves 128 at the leading edges of buckets 118. These slots are primarily to accommodate the shank of the cutter used to form the buckets. They also eliminate excess metal from the rotor and lower wheel and bucket stresses.

The nozzle ring 28 surrounding rotor 22 is clamped against the flange 40 at the upstream end of discharge housing 32 by a radial flange 130 on the downstream side of inlet manifold 36 and by the bolts 132 and nuts 134 securing the inlet manifold to flange 40.

The nozzle ring is prevented from rotating by a dowel 135 which extends through it into flange 40.

As best shown in FIG. 3, equiangularly spaced nozzles 137 are milled or otherwise formed in the upstream side of nozzle ring 28 in alignment with the entrances 120 to buckets 118 (see FIG. 2).

Those surfaces of the nozzles facing the outer and inner peripheries of the nozzle rings are bounded by nozzle ring vanes 137 between which the nozzles are located (vanes 137 are formed by metal left in the process of milling the nozzles). The front or upstream walls of the nozzles are formed by the downstream or back side of inlet manifold flange 130, and their downstream sides or walls are formed by nozzle ring material left after the nozzles are milled.

Each nozzle 137 has a convergent inlet section with an inlet 138 opening onto the outer periphery of the nozzle ring. The nozzles also have a divergent outlet section with a curved inner wall 140 and an outlet 142 opening onto the inner periphery of the nozzle ring in radial alignment with bucket entrances 120. The cross-sectional configuration of the nozzle at its discharge or exit end is preferably square in a direction perpendicular to the flow of working fluid.

As shown in FIGS. 3 and 5, the outlets 142 of nozzles 136 form an almost continuous circle around rotor 22. This, together with the $\leqq 3°$ wedge angle (or angle of divergence) 143 (see FIG. 4) provides essentially full are admission of working fluid to the buckets and insures that the buckets are smoothly filled. That contributes significantly to the efficiency of the turbine as discussed above. Significant contributions to efficiency are also made by the convergent-divergent configuration of the nozzles and by the curved inner wall configuration employed in the divergent nozzle outlet section.

Efficiency is also promoted by completely shrouding buckets 118 between their entrances 120 and exits 122. This is accomplished by nozzle ring 28 and the inner shroud portion 144 of discharge casing flange 40. The foregoing are abutted as shown in FIG. 2, and they completely surround wheel 22. This complete shrouding minimizes power robbing turbulence as indicated above. It also promotes efficiency by maintaining a free surface on the exit side of each bucket. Furthermore, because the exiting working fluid does not impinge on flange 40, its leaving or exit momentum is preserved. This is an attribute of particular importance in multi-stage turbines embodying the principles of the present invention.

Yet another contribution to efficiency is made by the above-described combination of square nozzles and square buckets.

One exemplary turbine of the character just described is designed to produce 324 horsepower at 8690 rpm when operated on air at 160 psig, and 429 horsepower at 11522 rpm when operated on natural gas at the same pressure.

Rotor 22 of this turbine is 21 inches in diameter, and it has 45 equally spaced buckets 118 opening onto its outer periphery.

Buckets 118 are 1.75 inches wide (or long), and they have a 0.3 inch square cross-section.

The flats 125 at the leading edges of the buckets span buckets 118 and extend a nominal 0.875 inch in the direction of wheel rotation.

The nozzle ring 28 of this exemplary turbine, also typically fabricated of an aluminum alloy for the same reason as rotor 22, has an inner diameter of 21.06 inches and an outer diameter of 23.5 inches; and it has 30 nozzles with $0.3 \times 0.3$ inch square outlets.

The curved inner walls 140 of the nozzle outlet sections lie along arcs of 3 inch radius, and the angle of trailing edge divergence (143 in FIG. 4) is $2\frac{1}{4}°$. This is well below the 3° needed to insure that the stream from one nozzle will fill the wake of the stream from the preceding nozzle, thereby eliminating shock waves, and to insure that the buckets 118 in rotor 22 are completely filled and maximum efficiency thereby obtained.

Referring now to FIGS. 2 and 3, the working fluid for turbine 20 enters manifold 36 from inlet 146 and flows axially from the manifold through an annular outlet nozzle 148 defined by the inner wall of the manifold and the periphery of the radially oriented flange 130 on the downstream side of the manifold. The working fluid then flows radially into the inlets 138 of nozzles 136.

Working fluid is discharged, tangentially and radially, from the nozzles into buckets 118 as shown by arrow 151 in FIG. 2. It flows across the radial impulse surfaces 124 of the buckets as shown by arrow 152 in FIG. 5, rotating wheel 22 and shaft 24 in the direction indicated by arrow 154; and it is discharged radially outward into discharge plenum 44 as indicated by arrow 156 (see FIG. 2). This combination of radial impulse surface and inlet and outlet flow vectors which parallel each other and the path of rotation of wheel 22 maximizes efficiency as indicated above.

From plenum 44, the working fluid is discharged from turbine casing 30 through the outlet 46 referred to above.

Figures 7, 10:
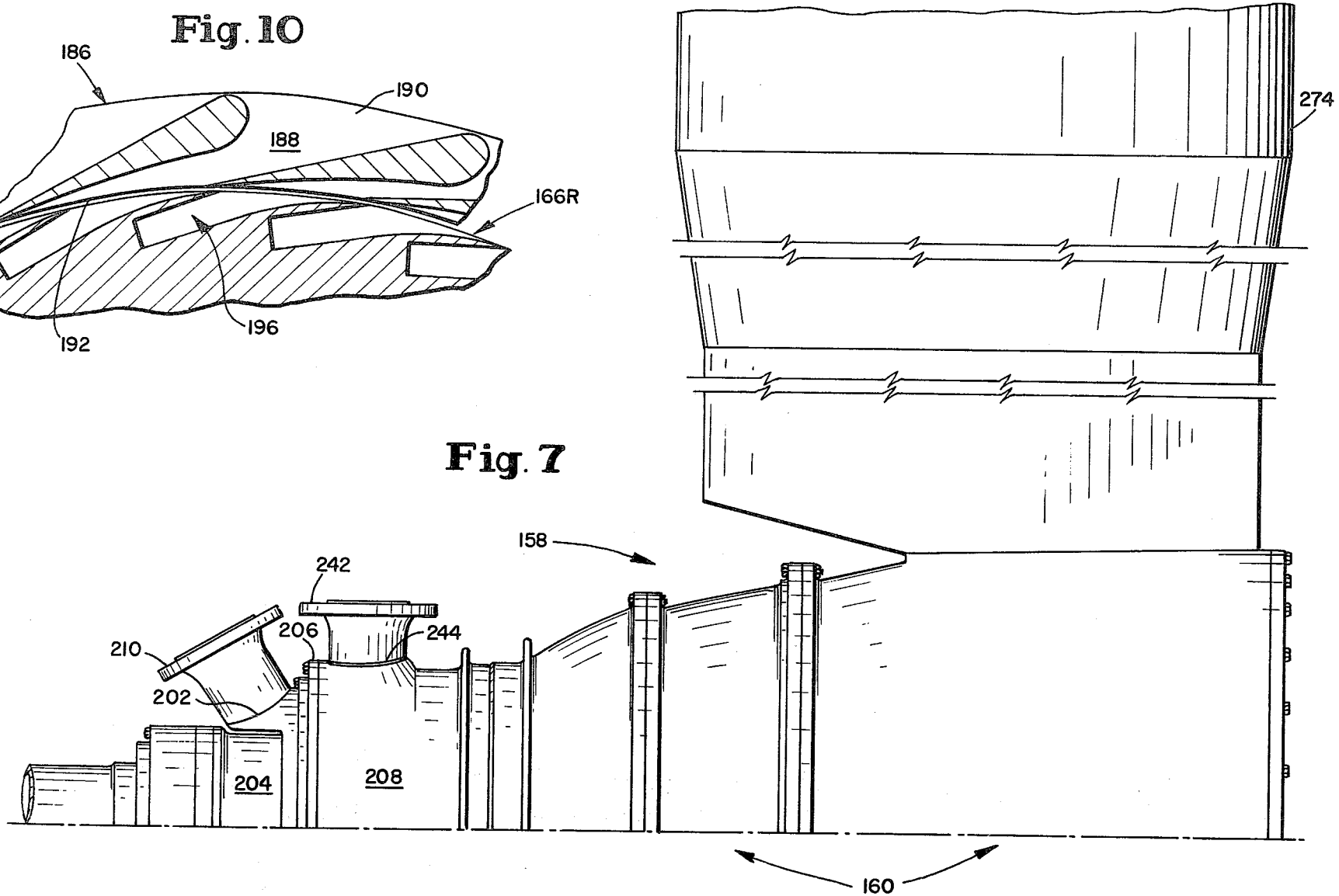
FIG. 7 is a partial side view of a dual pressure steam turbine constructed in accord with the principles of the present invention; it has a high pressure, multiple stage, radial inpulse section also embodying and constructed in accord with the principles set forth herein and a low pressure, multiple stage, axial flow section.
FIG. 10 is a fragmentary section through the first radial impulse stage in the high-pressure section of the turbine.

As indicated previously, radial impulse stages of the character just described can be used to advantage in turbines employing steam and comparable elastic fluids as working fluids. One turbine of that character, and of the dual pressure class, is illustrated in FIG. 7 and identified by reference character 158.

As will become apparent below, turbine 158 also employs one exemplary arrangement of multiple radial impulse stages embodying the principles of my invention.

Turbine 158 includes an elongated, external casing or housing 160 which has a generally circular cross-section and is made up of a number of bolted-together casing components. The details of the housing are not part of the present invention; and they will, accordingly, not be described herein except as necessary to facilitate an understanding of the invention.

Figure 8:
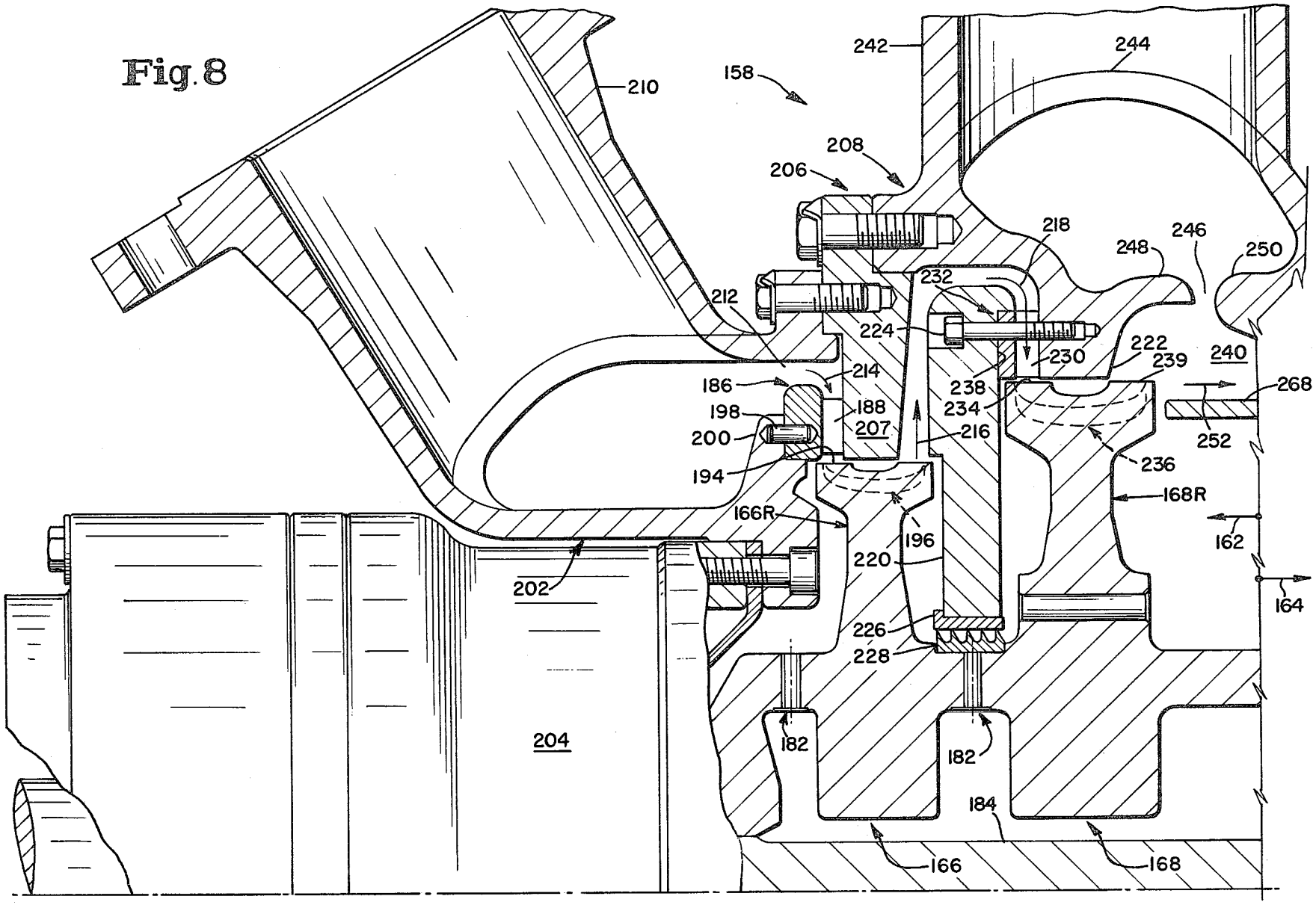
FIG. 8 is a partial section through the turbine devoted primarily to the details of its high pressure section.
Figure 9:
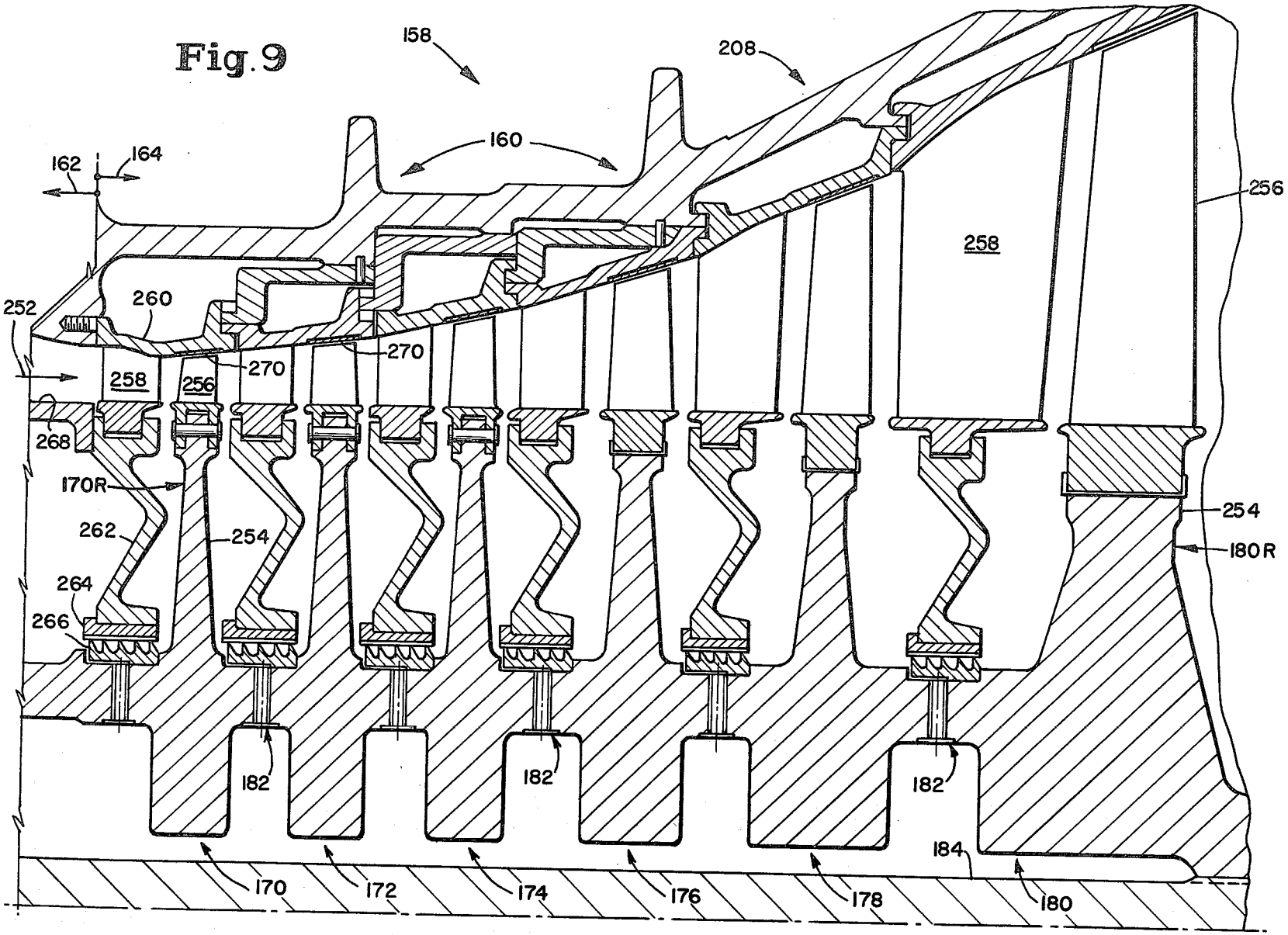
FIG. 9 is a section of similar character included to show the details of the turbine's low pressure section.

The interior of casing 160 is divided into a high pressure section 162 and a low pressure section 164 (see FIGS. 8 and 9).

High pressure section 162 has two impulse turbine stages 166 and 168; and low pressure section 164 has six conventional, axial flow turbine stages 170, 172, 174, 176, 178 and 180.

Each of the high and low pressure turbine stages includes a wheel or rotor which is identified by the same reference character as the stage but followed by the letter R.

The eight rotors 166R . . . 180R are coupled together with Curvic splines (assembled Curvic fittings are shown diagrammatially in FIG. 9 and identified by reference character 182). The components of the resulting assembly are held together by a single tension bolt 184, and the assembly is rotatably supported in casing 180 by appropriate bearings (not shown). The upstream (or front) end of the assembly is splined to accept a drive coupling (the splines are not shown).

Referring now specifically to FIG. 8, the first and second stage rotors 166R and 168R in the high pressure section 162 of turbine 158 are like the rotor 22 employed in turbine 20 and discussed above except that they will typically be cast from 17-4 PH stainless steel or a comparable material for steam service instead of being fabricated from an aluminum alloy and then machined. Also, as shown in FIG. 10, the inner surfaces of the rotor buckets may have the more efficient curved surfaces discussed above and shown in exemplary form in FIG. 5.

First stage rotor 166R is surrounded by an annular nozzle ring 186 with nozzles which may be of the type previously described but are preferably of the convergent configuration illustrated in FIG. 10 and identified by reference character 188. Those nozzles have an inlet 190 opening onto the outer periphery of the nozzle ring and an outlet 192 opening onto its inner periphery, and they are of square cross section at their discharge ends.

The outlets of nozzles 188 are radially aligned with the entrances 194 to the buckets 196 in the first stage rotor 166R as shown in FIG. 8.

Nozzle ring 186 is coupled by an antirotation pin 198 to a radial flange 200 at the downstream end of an annular, high pressure inlet manifold 202. The manifold is bolted between casing components 204 and 206 on the upstream side of high pressure section first stage rotor 166R.

Nozzle ring 186 is clamped against flange 200, and the downstream walls of nozzles 188 formed, by the plate-like inner portion or shroud 207 of casing component 206. The latter is bolted between manifold 202 and outer casing component 203. Shroud 207 functions in the same manner as the corresponding shroud employed in turbine 20 and discussed above.

Working fluid is supplied to the first stage 166 of turbine 158 through an inlet 210 which communicates with the interior of high pressure inlet manifold 202. The working fluid flows axially from the manifold through a circular nozzle 212 between the outer periphery of nozzle ring 186 and the inner wall of manifold 202. It then flows radially inward into the nozzles 188 in nozzle ring 186 as shown by arrow 214 in FIG. 8.

The working fluid is discharged from the nozzles into buckets 196 of rotor 166R, flowing through the latter to drive the rotor. It then flows radially outward as indicated by arrow 216. The entrance and exit flow vectors of the working fluid are once again parallel, providing the above-discussed advantages of that flow arrangement.

The outwardly flowing working fluid discharged from the buckets of rotor 166R is turned first axially and then radially inward (see arrow 218) by the cooperation between housing component 208 and an annular, disc-like flow director 220. The latter is fixed to the upstream side of a radially and inwardly extending annular flange 222 on casing component 208 by threaded fasteners 224.

Leakage between flow director 220 and the assembly of turbine rotors 166R . . . 180R is inhibited by cooperating seals 226 and 228. These seals are supported by the flow director at its inner periphery and by high pressure section first and second stage rotors 166R and 168R.

The working fluid discharged from first stage 166 flows into nozzles 230 formed in a nozzle ring 232 surrounding second stage rotor 168R. Again, the nozzle outlets are aligned with the entrances (234) to buckets of the character discussed above and identified by reference character 236.

Nozzle ring 232 is seated in a recess 238 in flow director 220 and is clamped against the upstream side of flange 222 by the flow director and fasteners 224. The upstream face of the flange forms the rear or downstream walls of the nozzles.

Nozzles 230, not shown in detail herein, will preferably be of a convergent configuration like that shown in FIG. 10 for the reasons discussed above.

The second stage rotor 168R is, like those discussed previously, completely shrouded. In this case, the shrouding is effected by the circular, radially oriented flange or boss 222 on casing component 208.

After passing through the buckets 236 of second stage turbine rotor 168R, the working fluid is discharged radially outward from the buckets through exits 239 into an annular plenum 240 located between high and low pressure turbine sections 162 and 164. Here, the working fluid discharged from the high pressure section of the turbine is combined with working fluid introduced to the turbine through inlet 242 and an annular low pressure inlet manifold 244 surrounding plenum 240.

Communication between the manifold and plenum 240 is effected by an inwardly directed, circular nozzle 246. The nozzle is defined by axially extending, circular bossess 248 and 250, which are integral parts of the casing component 208, and by manifold 244 and inlet 242.

The working fluid mixture flows axially as indicated by arrow 252 in FIGS. 8 and 9 into the low pressure section 164 of turbine 158. That section of the turbine 158 (which is of conventional axial flow design) is best shown in FIG. 9.

Each turbine stage in the low pressure section includes a rotor, previously mentioned, composed of a disc 254 to which an annular array of blades 256 is attached. Upstream from each rotor is a conventional annular array of stationary nozzles 258. The nozzles of each stage are attached to an annular nozzle support 260 which is fixed to casing component 208.

Leakage past the nozzles in each stage is inhibited by a circular diaphragm 262, a seal 264 at the inner circumference of the diaphragm, and a cooperating seal 266 supported by the discs of adjacent rotors.

An axially extending, circular flange 268 is fixed to the diaphragm 262 of the first axial flow stage 170 to guide the working fluid mixture from annular exhaust plenum 240 into the nozzles 258 of the first axial turbine stage.

As is also shown in FIG. 9, each of the low pressure, axial flow stages preferably includes an annular, abradable rub ring 270 which is part of the nozzle support of that stage and surrounds its rotor. These rub rings allow minimum tip clearance for the working fluid to be employed, lowering leakage of the working fluid past the blade tips.

Flow of the working fluid through the low pressure section is conventional with the working fluid being discharged from the blades 256 of the sixth stage rotor 180R into an annular exhaust manifold (not shown). The working fluid is discharged from this manifold and the turbine casing through exhaust duct 274 (see FIG. 7).

One turbine of the character just described, designed to produce 1800 shaft horsepower (600 of that in the high pressure impulse section), is shown at approximately 80 percent of full scale in FIGS. 8 and 9.

Typically, this turbine will be supplied with high pressure steam at 200 psia and 720° F. at a rate of 3.23 lbs./second and with low pressure steam at 40 psia and 790° F. at 0.76 lbs/second.

The design pressure of the steam exhausted from the last stage of the low pressure, axial flow section of the turbine is 0.65 psia.

The rotors of the two impulse stages 166 and 168 in the high pressure section 162 of turbine 158 are, respectively, 11.75 and 13.875 inches in diameter; and the mid-chord lengths of the blades 256 in the low pressure axial flow section of the turbine range from 0.6 inch in the first stage 170 to 5.16 inches in the sixth stage 180. The discs on which the blades are mounted are all 13.5 inches in diameter.

Figure 11:
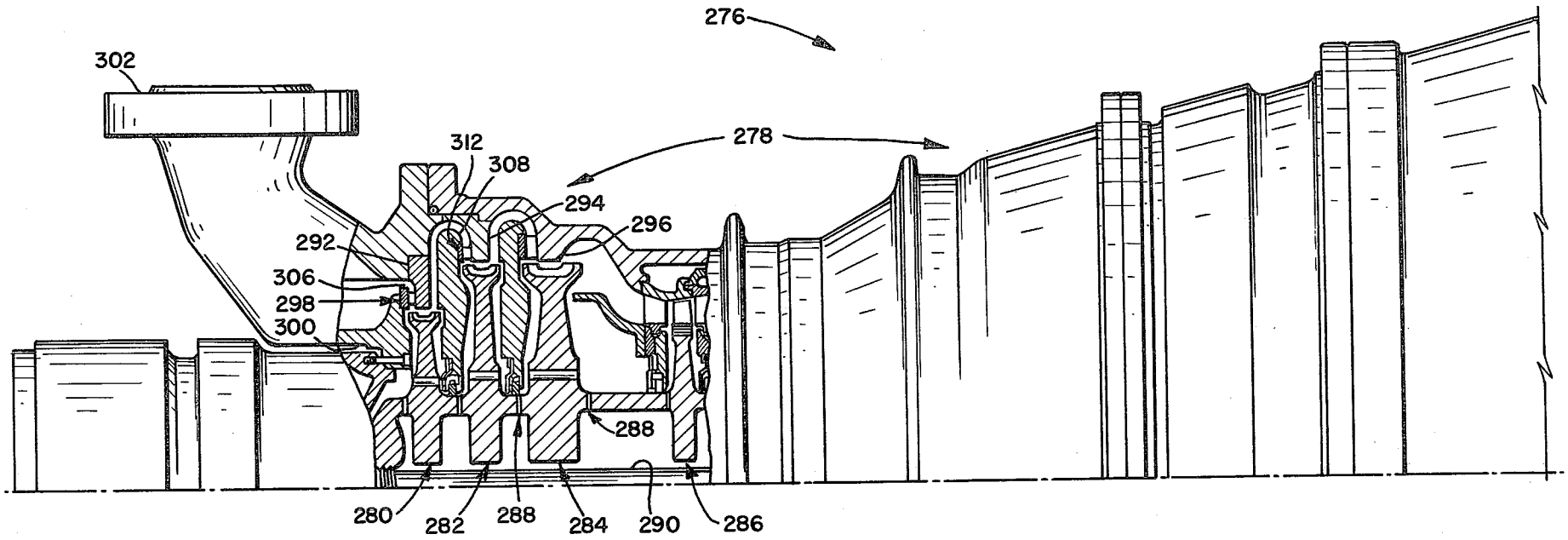
FIG. 11 is a view of similar to FIG. 7 of a once-through turbine constructed in accord with and embodying the principles of the present invention, the external casing being broken away to show certain important internal components of the turbine.

Advantage of the principles of the present invention may also be taken in designing once-through turbines having a combination of radial impulse and axial flow stages. A turbine of that type, which also includes a more efficient arrangement for transferring working fluid from one radial impulse stage to the next and which demonstrates that more than two radial inpulse stages can be employed in the turbines I have invented, is shown in FIG. 11 and identified by reference character 276.

In many respect, turbine 276 is similar to those disclosed above or has components so related. Consequently, and for the sake of clarity and conciseness, turbine 276 will be described primarily in reference to those features which distinguish it from the turbines discussed above.

Turbine 276 includes an elongated, external casing 278 housing three radial impulse stages 280, 282, and 284 and seven axial flow stages 286 . . . (only one of which is shown).

Each of the axial flow stages (which can be of the character described above in conjunction with turbine 158) and each of the impulse turbine stages includes a wheel or rotor which is identified by the same reference character as the stage but followed by the letter R.

The ten rotors 280R . . . 286R . . . are coupled together by Curvic fittings 288 and held in assembled relationship by a tension bolt 290. Appropriate bearings (not shown) rotatably support the resulting assembly in casing 278.

The rotors 280R, 282R, and 284R of the radial impulse stages may be like those employed in turbine 158; and they are surrounded by shrouds 292, 294, and 296 to obtain those above-discussed benefits which complete shrouding is capable of providing.

First stage rotor 280R is surrounded by an annular nozzle ring 298 with nozzles of the type illustrated in FIG. 10.

Nozzle ring 298 is clamped between shroud 292 and a working fluid inlet manifold 300.

Working fluid is supplied to the first stage 280 of turbine 276 through a working fluid inlet 302 which communicates with the interior of inlet manifold 300. The working fluid flows from the manifold through a circular nozzle 306 into the nozzles in the nozzle ring.

The working fluid is discharged from the nozzles into the buckets of rotor 280R, flowing through the latter to drive the rotor.

The outwardly flowing working fluid discharged from the buckets of rotor 280R is turned first axially and then radially inward by the cooperation between turbine casing 278 and a flow director 308. The latter is similar to the flow directors employed in the turbine 158 shown in FIG. 8. This keeps the stream of working fluid exiting from the buckets from spreading as it is directed from the first stage rotor 280R to the nozzle ring 312 in the second radial impulse stage 282. That is important in that it minimizes energy losses as the transfer of fluid is affected.

The operation of second and third radial impulse stages 282 and 284 and the transfer of the working fluid between the latter are both essentially as just described and as discussed in conjunction with the previously illustrated embodiments of my invention.

From the rotor of the third radial impulse stage 284 the working fluid flows against the surface of shroud 296, turning into the first of the axial flow stages 286.

Flow of the working fluid through the axial flow stages is conventional with the working fluid being discharged from the last stage rotor into an annular exhaust manifold (not shown). The working fluid is discharged from this manifold and the turbine casing through an exhaust duct similar to that shown in FIG. 7.

It will be apparent to those skilled in the relevant arts that three is not a limit on the number of radial impulse stages that can be employed in the radial impulse turbines or radial impulse turbine sections of the present invention and that efficiency can be increased by increasing the number of stages. However, three stages is considered a practical limit for the most part, simply because subsequent stages tend to become too massive.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefor intended to be embraced therein.

What is claimed and desired to be secured by Letters Patent is:

1. A full admission, multiple stage, radial impulse turbine comprising: first and second stage wheels, each having buckets spaced around and opening onto the periphery thereof; means mounting said first and second stage wheels in spaced relation along and for rotation about an axis coincident with the axial centerline of the turbine; an annular array of working fluid distribution nozzles surrounding each of said first and second stage wheels and oriented to discharge working fluid therefrom into said buckets; vanes alternating with and determining the contours of said nozzles, said vanes having surfaces facing the axial centerline of the turbine which are continuously curved from a first location corresponding to the exit from each nozzle to a second location corresponding to the trailing edge of the adjacent nozzle and the angle of divergence at those edges of the vanes corresponding to the exits of the nozzles being a maximum of ca. 3°; means for conducting working fluid discharged from the buckets of the first stage turbine wheel into the nozzles surrounding the second stage turbine wheel after that fluid has passed through a single bucket of the first stage turbine wheel; and a discharge plenum on the downstream side of the second stage turbine wheel, the buckets in said second stage turbine wheel being so configured as to dump the working fluid into said discharge plenum after that fluid has passed through a single bucket of said second stage wheel.

2. A full admission radial impulse turbine comprising: a wheel having buckets formed around and opening onto the periphery thereof, means mounting said wheel for rotation about an axis corresponding to the axial centerline of the turbine, and means for introducing a working fluid into said buckets which comprises nozzles spaced around the periphery of said wheel and oriented to discharge the working fluid therefrom into said buckets, the means for introducing working fluid into said buckets also including vanes alternating with and determining the contours of said nozzles, said vanes having surfaces facing the axial centerline of the turbine which are continuously curved from a first location corresponding to the exit from each nozzle to a second location corresponding to the trailing edge of the adjacent nozzle and the angle of divergence at those edges of the vanes corresponding to the exits of the nozzles being a maximum of ca. 3°, said turbine also having a discharge plenum on the downstream side of said wheel and the buckets formed in said wheel being so configured as to dump the working fluid into said discharge plenum after that fluid has passed through a single bucket.

3. A radial impulse turbine as defined in claim 2 wherein said nozzle surfaces are arcuate and have a radius approximating the radius of the periphery of the turbine wheel.

4. A radial impulse turbine as defined in either of the preceding claims 1 or 2 wherein the nozzles are of the convergent-divergent type.

5. A radial impulse turbine as defined in either of the preceding claims 1 or 2 wherein the nozzles are of the convergent type.

6. A full admission, multiple stage, radial impulse turbine comprising: a casing; first and second stage wheels, each having buckets spaced around and opening onto the periphery thereof with said buckets being configured to discharge working fluid passed therethrough in a radially outward direction; means rotatably mounting said wheels in axially spaced relation in said casing; first and second stage nozzle rings containing annular arrays of convergent-divergent type working fluid distribution nozzles surrounding said first and second stage wheels, said nozzles each having an inlet opening onto the outer periphery of the ring in which it is formed and an outlet opening onto the inner periphery thereof; flow directing means in said casing for turning working fluid discharged radially from the buckets in the first stage wheel after a single pass therethrough longitudinally toward the second stage wheel and then radially inward and into the inlets of the nozzles formed in that nozzle ring which surrounds the second stage wheel; and an annular discharge plenum on the downstream side of said wheel and the buckets formed in said wheel being so configured as to dump the working fluid into said discharge plenum after that fluid has passed through a single bucket.

7. A full admission, multiple stage, radial impulse turbine comprising: a casing; first and second stage wheels, each having buckets spaced around and opening onto the periphery thereof with said buckets being configured to discharge working fluid passed therethrough in a radially outward direction; means rotatably mounting said wheels in axially spaced relation in said casing; first and second stage nozzle rings containing annular arrays of convergent type working fluid distribution nozzles surrounding said first and second stage wheels, said nozzles each having an inlet opening onto the outer periphery of the ring in which it is formed and an outlet opening onto the inner periphery thereof; flow directing means in said casing for turning working fluid discharged radially from the buckets in the first stage wheel after a single pass therethrough longitudinally toward the second stage wheel and then radially inward and into the inlets of the nozzles formed in that nozzle ring which surrounds the second stage wheel; and an annular discharge plenum on the downstream side of said wheel and the buckets formed in said wheel being so configured as to dump the working fluid into said discharge plenum after that fluid has passed through a single bucket.

* * * * *

UNITED STATES PATENT AND TRADEMARK OFFICE

CERTIFICATE OF CORRECTION

PATENT NO. : 4,435,121

DATED : Mar. 6, 1984

INVENTOR(S) : Leon R. Wosika

It is certified that error appears in the above-identified patent and that said Letters Patent is hereby corrected as shown below:

Column 6, line 34, change "goodmatch" to --good match--

Column 7, line 18, change "are" to --arc--

Column 9, line 24, change "203" to --208--

Signed and Sealed this

*Third* Day of *July 1984*

[SEAL]

*Attest:*

GERALD J. MOSSINGHOFF

*Attesting Officer*

*Commissioner of Patents and Trademarks*